United States Patent [19]

Graham

[11] 4,066,721

[45] Jan. 3, 1978

[54] THROTTLE BODY HAVING A NOVEL THROTTLE BLADE

[75] Inventor: Kenneth A. Graham, Beverly Hills, Mich.

[73] Assignee: Chrysler Corporation, Highland Park, Mich.

[21] Appl. No.: 719,206

[22] Filed: Aug. 30, 1976

[51] Int. Cl.[2] ..... F02M 17/40

[52] U.S. Cl. ..... 261/62; 138/45; 138/46; 251/212; 261/65

[58] Field of Search ..... 261/DIG. 56, 65, 62; 251/212; 138/45, 46

[56] References Cited

U.S. PATENT DOCUMENTS

| | | | |
|---|---|---|---|
| 825,499 | 7/1906 | Sturtevant | 261/65 |
| 1,061,835 | 5/1913 | Gobbi | 261/62 |
| 1,129,864 | 3/1915 | Haas | 261/65 |
| 1,437,423 | 12/1922 | Jackson | 261/65 |
| 1,462,641 | 7/1923 | Jackson et al. | 261/65 |
| 1,504,507 | 8/1924 | Richardson | 261/65 |
| 2,084,489 | 6/1937 | Hess | 261/50 A |
| 2,436,319 | 2/1948 | Meyer | 261/65 |
| 3,047,277 | 7/1962 | Landrum | 261/65 |
| 3,659,572 | 5/1972 | Pelizzoni | 261/DIG. 56 |
| 3,752,451 | 8/1973 | Kendig | 261/50 A |

FOREIGN PATENT DOCUMENTS

| | | | |
|---|---|---|---|
| 77,094 | 4/1947 | Czechoslovakia | 261/DIG. 56 |
| 171,980 | 1/1923 | United Kingdom | 261/65 |

*Primary Examiner*—Tim R. Miles
*Attorney, Agent, or Firm*—Baldwin & Newtson

[57] ABSTRACT

A throttle body assembly comprises a throttle body having an induction passage therein with a pair of rotatively coupled, parallel shafts extending across the induction passage. A pair of blades are affixed to each shaft with each blade comprising a main blade section for selectively restricting the induction passage in accordance with shaft rotation and an auxiliary blade section which presents a curved confronting surface to an adjacent wall portion of the induction passage so as to preclude intrusion of any appreciable amount of induction air between each blade and the corresponding wall portion over the operative rotational range of the shafts.

3 Claims, 9 Drawing Figures

THROTTLE BODY HAVING A NOVEL THROTTLE BLADE

BACKGROUND AND SUMMARY OF THE INVENTION

This invention relates broadly to throttle body assemblies and is particularly concerned with a throttle body assembly having novel throttle blade structure.

In a vehicle having an internal combustion engine, it is desirable to create as homogeneous a combustible mixture as possible in order to obtain more complete combustion in the cylinders of the engine. The steps toward attainment of the homogeneous mixture begin in a throttle body where fuel is introduced into the induction passage through which air is drawn. The present invention is directed to a throttle body assembly containing novel blade structure which is beneficial in promoting more homogeneous fuel/air mixture while selectively restricting the induction passage according to operation of the accelerator control linkage by the vehicle operator. The throttle blade comprises a main blade section which selectively restricts the induction passage in accordance with operator actuation and an auxiliary blade section which confronts an adjacent wall of the passage. By arranging such blades to operate in cooperating pairs, induction air is confined to a central region of the induction passage where the outlet of the fuel distribution system is located while intrustion of any appreciable amount of air, between the throttle blades and the corresponding adjacent walls of the induction passages, can be avoided without the necessity of using separate seals. Furthermore, the invention permits the use of essentially balanced blades so that excessive operating or biasing torques are not required. The throttle blades can be made economically from sheet or strip material.

The foregoing features, advantages, and benefits, along with additional ones, will be seen in the ensuing description and claims which are to be considered in conjunction with the accompanying drawings which disclose an illustrative, but preferred, embodiment of the present invention according to the best mode presently contemplated in carrying out the invention.

Reference to a Related Application

Reference is made to the application of Kenneth A. Graham and Kenneth W. Teague, entitled "Throttle Body Assembly," filed of even date herewith and identified by Ser. No. 719,021.

DESCRIPTION OF THE PREFERRED EMBODIMENT

Figure 1:
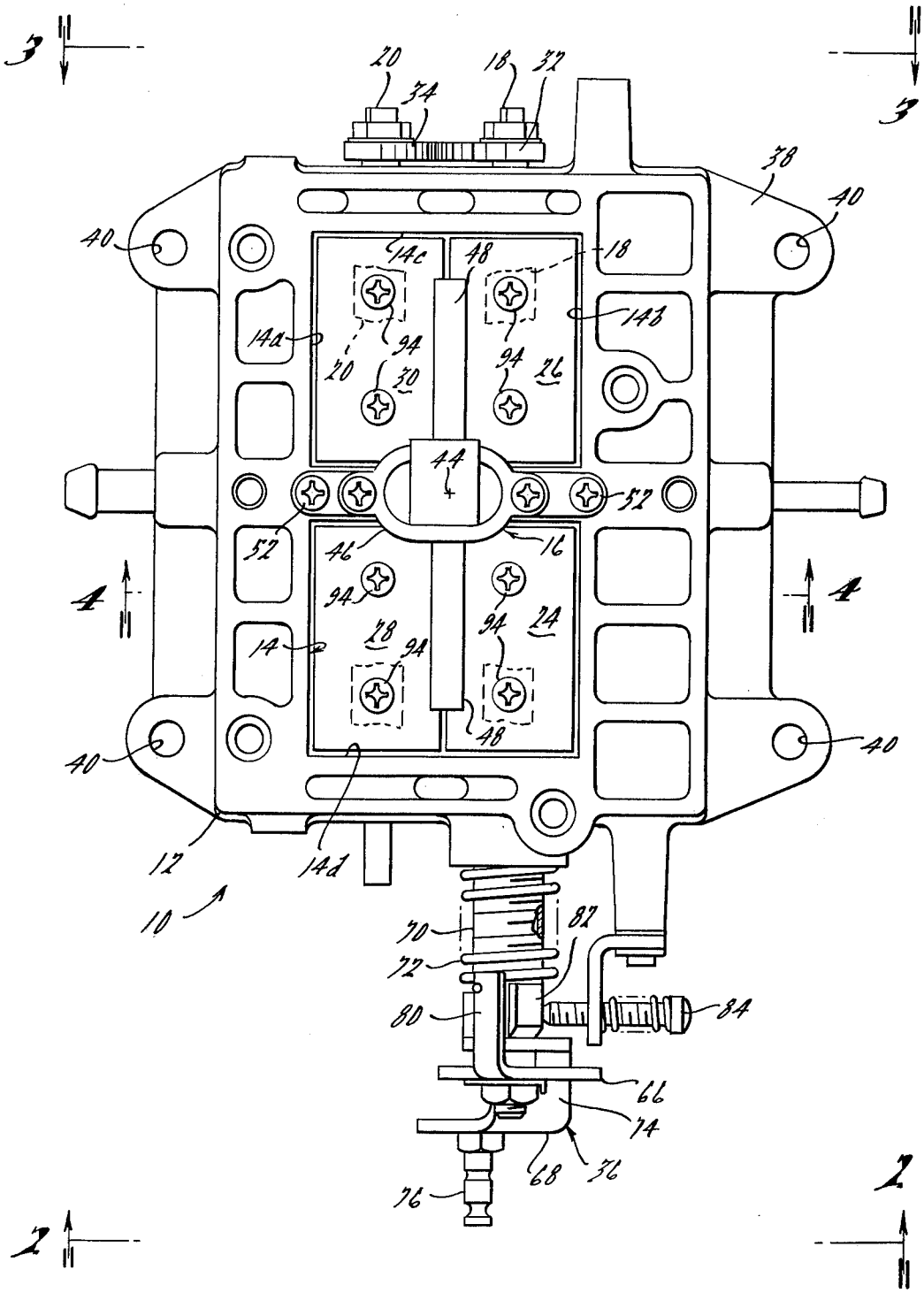
FIG. 1 is a plan view of a throttle body assembly embodying principles of the present invention.

FIGS. 1 through 4 illustrate a preferred embodiment of throttle body assembly 10 embodying principles of the present invention. Assembly 10 comprises a throttle body 12 having an air induction passage 14; a fuel distribution system 16; a pair of throttle shafts 18,20; four individual throttle blades 24,26, 28, 30; a pair of meshed sector gears 32, 34; and an actuating mechanism 36.

Throttle body 12 has a base 38 adapted to be positioned on an engine intake manifold (not shown) to register induction passage 14 with the inlet port of the intake manifold. Attachment may be effected by means of bolts (not shown) passing through holes 40 at the four corners of base 38 with a suitable gasket (not shown) disposed between throttle body 12 and the intake manifold. In the preferred emboidment disclosed herein, induction passage 14 has a rectangular cross-sectional shape as shown in FIG. 1. Passage 14 is divided into two halves, or ports, by means of a vertical partition 42 of throttle body 12 which intersects the main axis 44 of induction passage 14.

Fuel distribution system 16, which comprises a pressure regulator assembly 46 and a spray bar 48, mounts directly on partition 42, with a T-shaped recess 50 being fashioned in the partition to receive spray bar 48. Pressure regulator assembly 46 is keyed with spray bar 48, and the former attaches to throttle body 12 by means of a pair of screws 52, spray bar 48 in turn being securely retained within recess 50 by virtue of its keyed engagement with assembly 46. Spray bar 48 extends in opposite directions from partition 42, and is disposed midway between the longer opposite walls 14a, 14b of the induction passage 14 but stops somewhat short of the shorter walls 14c, 14d of passage 14. A main fuel distribution rail 54 and a power fuel distribution rail 56 extend lengthwise through spray bar 48. Spaced orifices 58 and 60 intercept the rails 54 and 56 at selected intervals along the length of the spray bar and direct fuel downwardly into passage 14. Greater detail of the illustrated fuel distribution system 16 is disclosed in the above-referenced patent application of Kenneth A. Graham and Kenneth W. Teague, entitled "Throttle Body Assembly." While this fuel distribution system is admirably suited for use with the present invention, it will be appreciated that the present invention does not depend upon the specific fuel distribution system which is utilized, and it is fully contemplated that other fuel distribution systems may be utilized with the present invention.

Turning now to a detailed consideration of the present invention, it can be seen that shafts 18 and 20 extend across passage 14 between the opposite walls 14c, 14*d*. Shaft 18 is disposed approximately half way between the axis 44 and wall 14*b*, while shaft 20 is located approximately half way between axis 44 and wall 14*a*, the two shafts 18 and 20 being parallel to each other as well as to walls 14*a* and 14*b*. The two shafts are suitably journaled in throttle body 12 at walls 14c and 14d as well as at partition 42 (through which the two shafts pass) for rotation about their own axes 62, 64. As shown at the top of FIG. 1, the ends of shafts 18 and 20 extend beyond throttle body 12, and the two meshed sector gears 32 and 34 are affixed to shafts 18 and 20 respectively. The sector gears 32, 34 are so meshed as to couple shafts 18 and 20 for rotation in unison in opposite directions as viewed axially of the shafts. Blades 24, 26 are affixed to shaft 18, and blades 28, 30 to shaft 20 so that blades 24, 28 form one cooperating blade pair for one port and blades 26, 30 another for the other port. It will be observed that the blades are at least approximately balanced so that pressure differential across the blades cannot develop any significant rotational torque. This means that extra-ordinary torques are neither required to maintain the blades in the idle position to which they are typically biased via the usual accelerator linkage return spring (not shown) nor required to operate the blades over their operating range.

Figure 2:
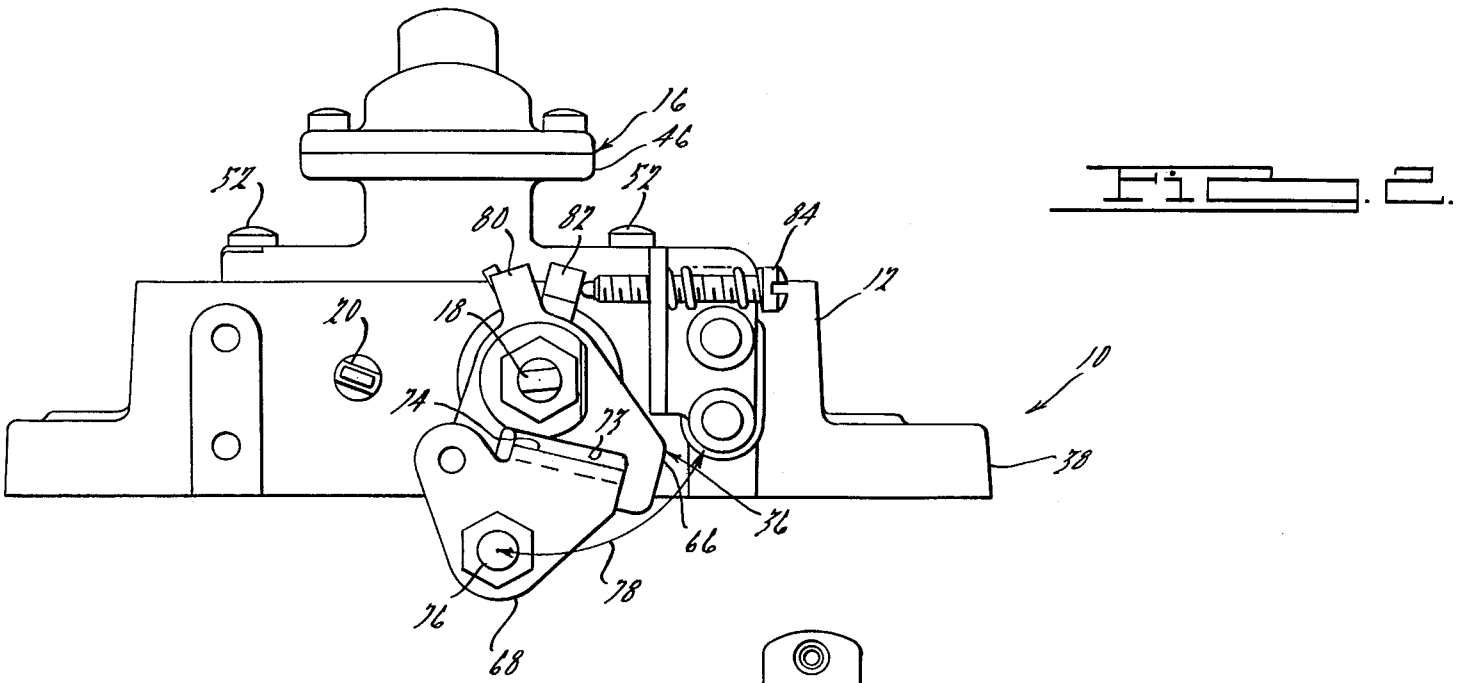
FIG. 2. is a view taken along line 2—2 in FIG. 1.
Figure 3:
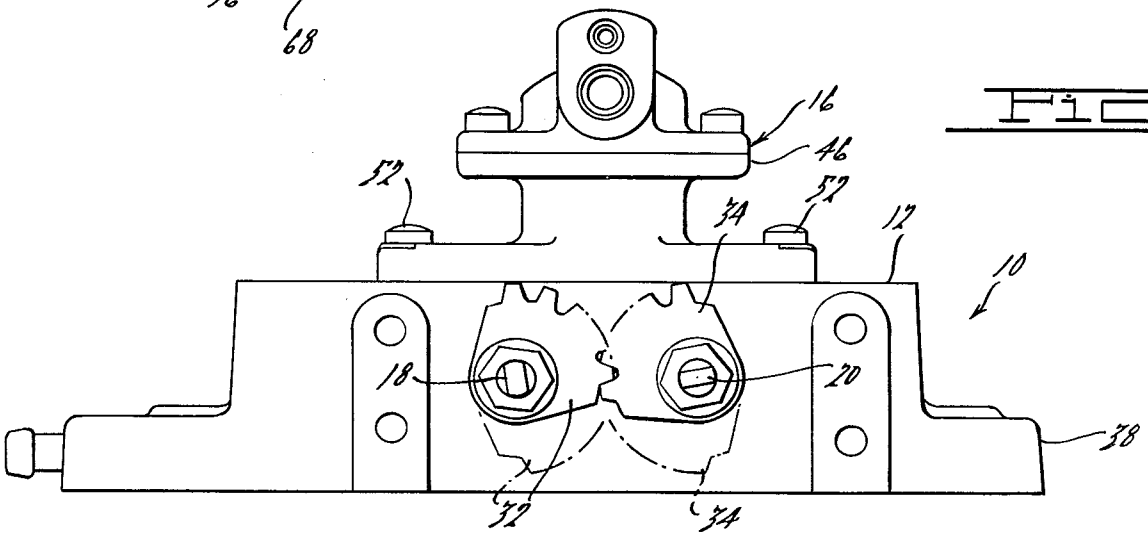
FIG. 3 is a view taken along line 3—3 in FIG. 1.

Actuating mechanism 36 serves to rotate shafts 18 and 20 (and hence the four throttle blades, 24, 26, 28, and 30) in response to operation of the usual accelerator linkage provided in a vehicle. The illustrated actuating mechanism comprises an idle arm 66, a throttle arm 68, a sleeve 70, and a helical spring 72. As shown at the bottom of FIG. 1, shaft 18 extends beyond throttle body 12 a distance sufficient to accommodate actuating mechanism 36. Sleeve 70 is disposed over shaft 18 to support spring 72 thereon. Idle arm 66 is affixed to shaft 18 for rotation therewith. Throttle arm 68 is free to rotate on shaft 18; however, the two arms, 66 and 68, are designed to provide a small angular lost-motion connection. This lost-motion connection is provided by means of a bight 73 fashioned in idle arm 66; throttle arm 68 is provided with a segment 74 which fits within bight 73 and is dimensioned to a width somewhat less than that of the bight. A pin 76 on throttle arm 68 is intended to connect with the accelerator linkage (not shown) whereby the throttle arm 68, in response to operation of the accelerator pedal by the vehicle operator, may be operated over an angular range indicated by the arrow 78 in FIG. 2. Spring 72 is torsionally interengaged between throttle body 12 and a tab 80 on idle arm 66 whereby arm 66 is biased in the clockwise direction as viewed in FIG. 2. In turn, a tab 82 on throttle arm 68 is biased into engagement with an idle adjustment screw 84 on throttle body 12 by virtue of the lost-motion connection between the two arms 66 and 68. FIG. 2, therefore, illustrates the assembly in the idle position. Details of the illustrated actuating mechanism (particularly the lost-motion connection between arms 66 and 68) relate to the subject matter disclosed in the foregoing application of Kenneth A. Graham and Kenneth W. Teague, entitled "Throttle Body Assembly," and do not directly pertain to the present invention. For purposes of the present disclosure, suffice it to say that as throttle arm 68 is displaced from the position shown in FIG. 2 along the arc 78, shafts 18 and 20 rotate in unison in opposite directions to in turn rotate the four throttle blades.

Figure 4:
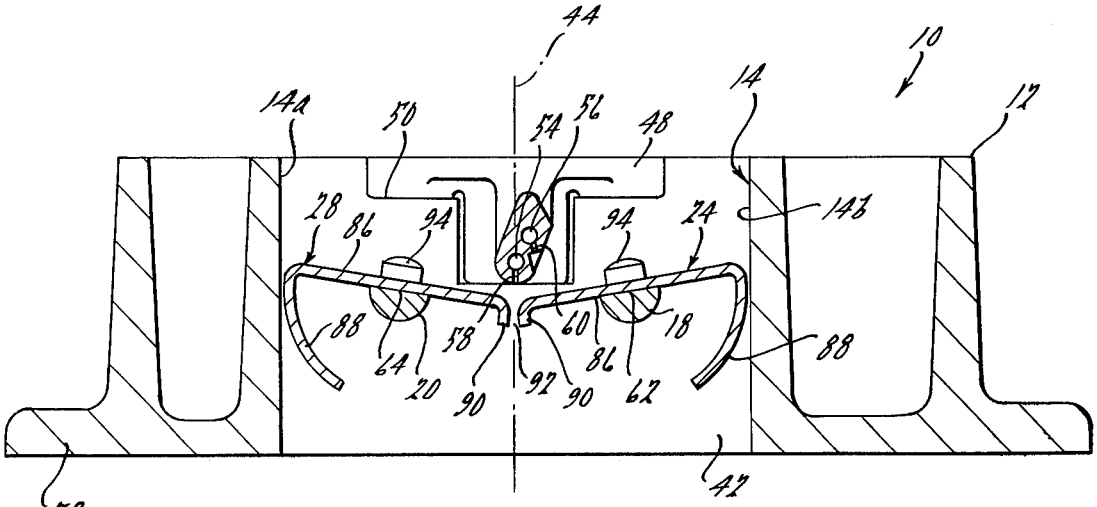
FIG. 4 is an enlarged sectional view taken along line 4—4 in FIG. 1.
Figure 5:
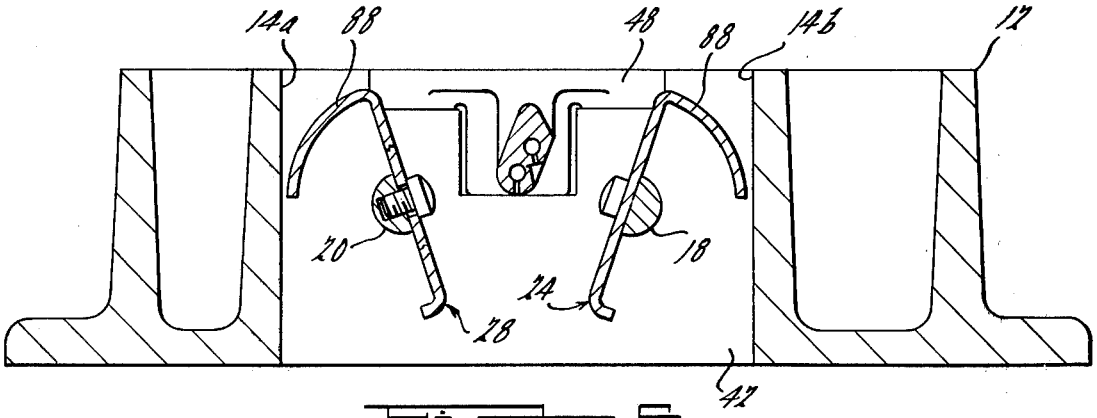
FIG. 5 is a view similar to FIG. 4 showing a different operative position.
Figure 6:
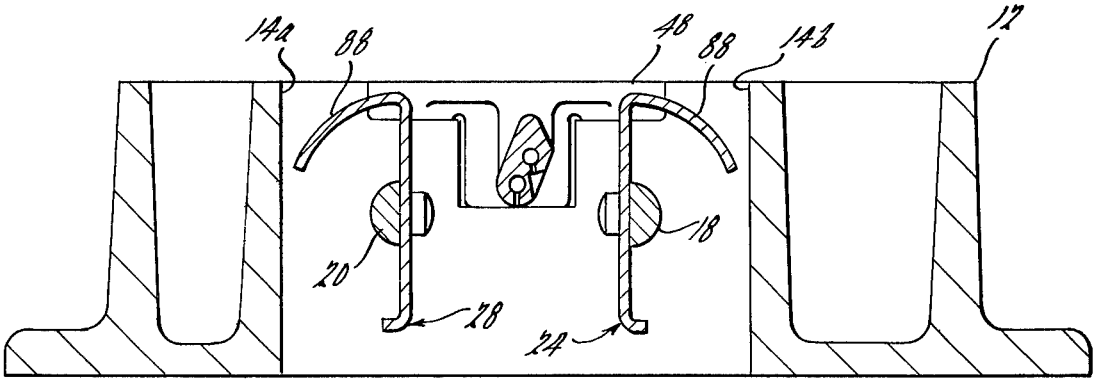
FIG. 6 is a view similar to FIGS. 4 and 5 showing a still further operative position.

Each throttle blade comprises a main blade section 86, an auxiliary blade section 88, and a lip 90. In the illustrated preferred embodiment the blades are advantageously constructed from sheet metal stock which is formed into the desired shape and then precision ground in a manner to be hereinafter described. The main blade section 86 of each blade lies in a flat plane. The length of each blade is dimensioned to fit closely between the shorter walls **14*c*, 14*d* of passage 14 and partition 42, while the blade width is such that when in idle position a restricted opening 92 is provided between the lips 90 of the cooperating blade pairs. In order to provide for attachment of the throttle blades to the throttle shafts, each throttle shaft has a pair of flats across a diameter thereof to each of which the main blade section of one of the blades is attached by means of screws 94. As shown in FIGS. 5 and 6, each restricted opening 92 increases in size as actuating mechanism 36 is increasingly displaced from idle position thereby reducing the restrictive effect. The auxiliary blade section 88 of each blade serves an important function as the throttle blades are increasingly displaced from idle position. As can be seen from consideration of FIGS. 5 and 6, each auxiliary blade section 88 presents a curved confronting surface to the corresponding wall section 14*a*, 14*b*. The dimensions are such that as the blades are displaced from the FIG. 4 position to the FIG. 5 position, a restrictive effect is maintained so that no appeciable amount of air is allowed to intrude between the auxiliary blade section and the corresponding wall section 14*a* and 14*b*. This is important in promoting the attainment of a more uniform and thorough combustible mixture since virtually all induction air is constrained to flow as a high velocity stream between the cooperating blade pairs where the fuel discharged from spray bar 48**.

In order to theoretically prevent any air from intruding between an auxiliary blade section and the confronting wall section of the induction passage, the surface of the auxiliary blade section confronting the induction passage wall section should like on a circular arc concentric with the corresponding shaft axis and having a radius of curvature infinitesimally less than the minimum distance from the shaft axis to the wall section. From a practical manufacturing standpoint, the attainment of such precision is impossible. While the illustrated blade has the advantage of being formable from sheet or strip stock, dimensional control of the precise shape of the auxiliary blade section is difficult, particularly on a production basis. This is because the angle subtended by the auxiliary blade section must be large enough to accommodate the range of angular travel of the throttle shafts, and the larger the angle, the more difficult to control dimensionally the auxiliary blade curvature. However, this problem is solved by designing the auxiliary blade section to have a radius of curvature just slightly less than the minimum distance from the shaft axis to the induction passage wall section and preferably slightly offset from the shaft axis toward the induction passage wall section. Manufacture is accomplished by forming the blade to the desired shape and then precision grinding the auxiliary blade section to the specified contour. As the throttle shafts rotate from the idle position, interference between the auxiliary blade sections and the corresponding confronting induction passage wall sections is precluded; yet the amount of clearance is sufficiently small that at most only negligible intrusion of air therebetween occurs. Thus, virtually all induction air is confined between cooperating blade pairs to mix with fuel discharged from the spray bar. Lips 90 are helpful in promoting good flow characteristics between the opposed free edges of the main blade sections of each blade pair.

An especially accurate, and preferred, assembly of the blades to the shafts can be accomplished by providing attachment holes in the blades which are somewhat larger than the shanks of attaching screws 94 and located to provide for limited adjustment of the blade on the shaft. With the shafts in idle position (such as shown in FIG. 4), the blades may be adjusted to provide edge contact of each auxiliary blade section with the corresponding wall section of the induction passage. Slight clearance at the ends of each blade to the throttle body is also provided. The screws 94 are then tightened to securely affix each blade in this position. Now when the shafts rotate, clearance is assured for the full range of throttle operation with an effective air seal being provided between the auxiliary blade sections and the corresponding confronting wall section of the induction passage. At and near wide open throttle, a small amount of air intrusion is tolerable. Tolerance is taken up between the lipped edges of each cooperating blade pair.

At idle, each blade is sealed with respect to the corresponding induction passage wall 14a, 14b by means of its auxiliary blade section 88. Because the length of each blade must be slightly less than the length of the corresponding port (e.g., the dimension between partition 42 and wall 14c in the case of blades 26 and 30), there is a greater percentage of air leakage around the lengthwise ends of the blads at idle in comparison to the amount of air passing through the restricted opening 92 between cooperating blade pairs. While this leakage should not be a problem so long as the lengthwise clearance between each blade and port can be closely controlled (for example 0.001 or 0.002 inch or less), it is contemplated that sealing along the end edges of the main section of each blade can bring about an improvement (particularly at idle operation) whereby the openings 92 can be slightly enlarged to promote maximum velocity central airflow in the vicinity of spray bar 48. One way of incorporating such edge seals is to spray a Teflon coating of 0.002/0.003 inch thickness onto the end edges of the blades. Another possibility is the use of edge lip seals.

Figure 7:
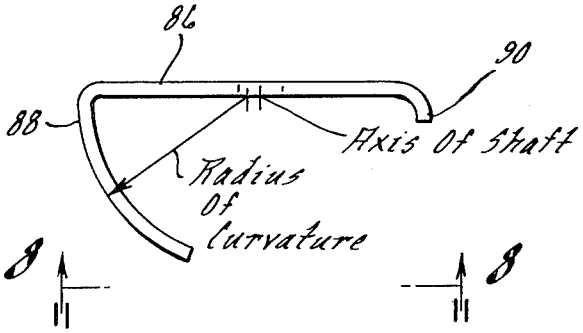
FIG. 7 is an enlarged end view of one of the throttle blades of the assembly of the preceding Figures shown by itself.
Figure 8:
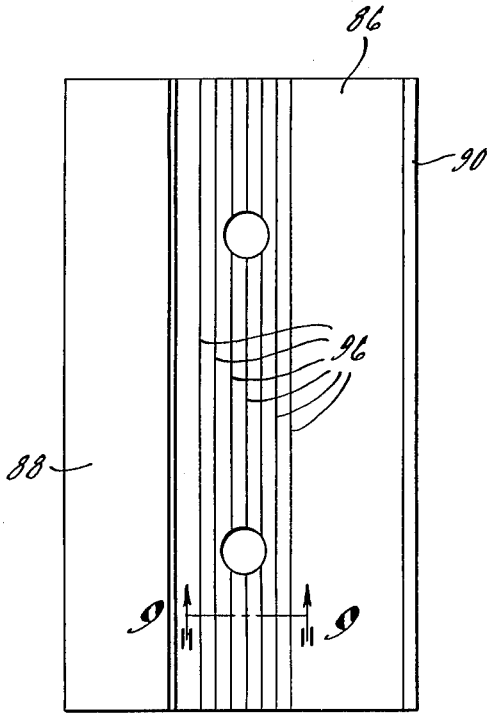
FIG. 8 is a view taken along line 8—8 in FIG. 7.
Figure 9:
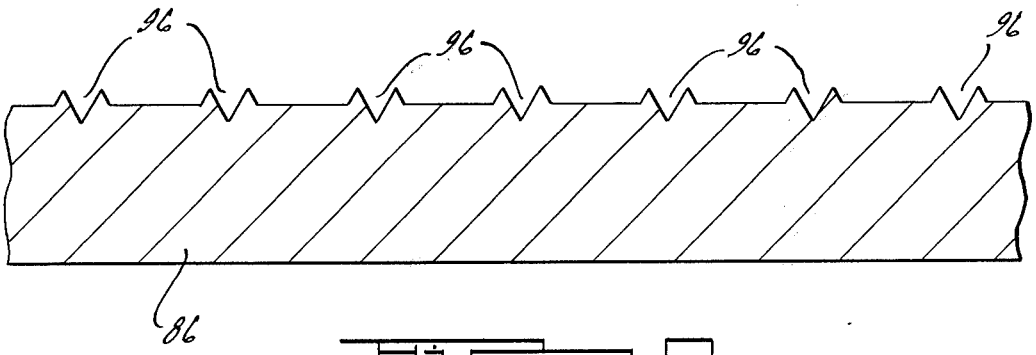
FIG. 9 is an enlarged sectional view taken along line 9—9 in FIG. 8.

FIGS. 7, 8, and 9 illustrate one of the blades in greater detail. FIG. 7 illustrates the geometrical relationship of the radius of curvature of auxiliary blade section 88 to the axis of the shaft to which the blade is attached. The illustrated example is made from 0.042 inch stock, has a length of about 2 inches, and the main blade section has a width of about 1.2 inches. The auxiliary blade section lies on an arc of about 75° . It is also desirable to apply a Teflon coating to each throttle shaft so that journal friction is minimized. Because it is more economical on a production basis to coat the entire shaft, the coating of the flats on which the blades seat provides a very low friction surface which may permit the throttle blades to shift on the shafts after screws 94 are tightened. Therefore, in order to preclude this possibility, a plurality of parallel scribe lines 96 are made on the surface of main blade section 86 which is disposed against the shaft flat. The scribe lines will raise edges along the surface of the blade which penetrate the shaft coating to embed in the shaft itself as the screws 94 are tightened thereby more securely holding the blade in the correct position on the shaft. The blade areas on each side of the shaft are not quite equal. Slightly larger area has been designed on the auxiliary blade side such that the blade itself tends to be self closing on the shaft due to vacuum forces.

The illustrated embodiment of throttle body assembly 10 is particularly suited for use with a V-8 engine whereby one bank of cylinders is essentially fed via one port of the assembly and the other bank, via the other port. Hence, with other engine configurations, other embodiments of the invention would normally be utilized. For one example, a throttle body for four cylinder engine might use only one set of cooperating blade pairs in a single port.

What is claimed is:

1. A throttle body assembly comprising in combination:

a throttle body having a straight induction passage therein comprising four flat walls which, in transverse cross section perpendicular to the axis of the passage, define a rectangular cross section for the passage;

a pair of shafts extending across said passage, each shaft being journaled for rotation on the throttle body about its own axis, one of said shafts being disposed between the passage axis and one wall of said passage, the other shaft being disposed between the passage axis and the opposite wall;

a throttle blade disposed within said passage and affixed to said one shaft in approximate balance thereon, said throttle blade being formed from sheet metal stock of uniform thickness into a shape comprising a flat, rectangular main blade section which, in idle position, extends from said one wall partially across said passage toward said opposite wall but stops short of the other shaft and which fits closely between the remaining two walls of said passage;

a second throttle blade identical to said first throttle blade disposed within said passage and affixed to said other shaft in approximate balance thereon, said second throttle blade also being formed from sheet metal stock of uniform thickness into a shape comprising a flat, rectangular main blade section which, in idle position, extends from said other wall partially across said passage toward said one wall and cooperates with the first throttle blade to define an opening therebetween;

means for rotating said shafts so that the juxtaposed edges of the main blade sections of said blades are displaced from idle position in the downstream direction to increase the area of said opening;

said first throttle blade comprising an auxiliary blade section extending from the edge of its main blade section opposite the edge thereof which is juxtaposed to said second blade, said auxiliary blade section fitting closely between said two remaining walls and presenting a curved confronting surface to said one wall, which when viewed in a transverse cross section perpendicular to the axis of the shaft to which it is attached, is disposed on an at least approximately circular arc which is at least approximately concentric with the axis of the corresponding shaft and has a radius of curvature smaller than the minimum distance from the axis of the corresponding shaft to said one wall, and which is so disposed relative to said one wall as to preclude the intrusion of any appreciable induction flow between said first throttle blade and said one wall as the blades are displaced from idle position over an initial range of operative positions, but which increasingly separates from said one wall as the blades are displaced beyond said initial range to permit induction air to pass between said first throttle blade and said one wall; and said second throttle blade comprising an auxiliary blade section extending from the edge of its main blade section opposite the edge thereof which is juxtaposed to said first blade, said auxiliary blade section of said second blade fitting closely between said two remaining walls and presenting a curved confronting surface to said other wall, which when viewed in a transverse cross section perpendicular to the axis of the shaft to which it is attached is disposed on an at least approximately circular arc which is at least approximately concentric with the axis of the corresponding shaft and has a radius of curvature smaller than the minimum distance from the axis of the corresponding shaft to said other wall, and which is so disposed relative to said other wall as to preclude the intrusion of any appreciable induction flow between the second throttle blade and said other wall as the blades are displaced from idle position over said initial range of operative positions, but which increasingly separates from said other wall as the blades are displaced beyond said initial range to permit induction air to pass between said second throttle blade and said other wall;

each of said throttle blades being of uniform cross sectional shape throughout its extent along the length of the axis of the shaft to which it is attached, as viewed in perpendicular cross section to the axis of the corresponding shaft.

2. The combination called for in the claim 1 wherein each main blade section includes a curved lip on the edge thereof which is in juxtaposition with the opposite throttle blade.

3. The combination called for in claim 1 wherein the auxiliary blade section of each blade extends along an arc of about 75 degrees as measured about the axis of the shaft to which it is attached.

* * * * *